United States Patent [19]

Schöneberger

[11] Patent Number: 4,581,993

[45] Date of Patent: Apr. 15, 1986

[54] DEVICE FOR A PRINTING PRESS COMPRISING A PLATE CYLINDER AND/OR BLANKET CYLINDER

[75] Inventor: Edgar F. Schöneberger, Seligenstadt, Fed. Rep. of Germany

[73] Assignee: M.A.N.-Roland Druckmaschinen Aktiengesellschaft, Fed. Rep. of Germany

[21] Appl. No.: 674,230

[22] Filed: Nov. 21, 1984

[30] Foreign Application Priority Data

Nov. 25, 1983 [DE] Fed. Rep. of Germany ..... 3342662

[51] Int. Cl.[4] ..... B41F 13/14; B41L 35/04

[52] U.S. Cl. ..... 101/217; 101/248; 101/415.1

[58] Field of Search ..... 101/248, 181, 182, 183, 101/184, 185, 136, 137, 138–140, 141–145, 217, 218, 378, 415.1, DIG. 12

[56] References Cited

U.S. PATENT DOCUMENTS

| | | | |
|---|---|---|---|
| 3,303,778 | 2/1967 | Tonkin et al. | 101/144 |
| 3,490,367 | 1/1970 | Kaneko et al. | 101/144 |
| 4,027,588 | 6/1977 | Tasaka et al. | 101/144 |
| 4,434,716 | 3/1984 | Ishii et al. | 101/142 X |

*Primary Examiner*—J. Reed Fisher

*Attorney, Agent, or Firm*—Leydig, Voit & Mayer, Ltd.

[57] ABSTRACT

A device for adjusting the plate or blanket cylinders in a rotary printing press automatically moves the cylinders to predetermined positions for clamping or unclamping the plate or blanket. A memory stores predetermined set values for cylinder position, which are addressed by a triggering unit in response to operation selections. An angle coder senses the actual value of the cylinder position which is compared to the set values obtained from the memory to generate a control signal for adjusting a cylinder drive motor. In a preferred embodiment, the memory also stores the direction for rotating the cylinders as well as a number of cylinder movement steps for plate and blanket clamping and unclamping sequences.

20 Claims, 5 Drawing Figures

DEVICE FOR A PRINTING PRESS COMPRISING A PLATE CYLINDER AND/OR BLANKET CYLINDER

BACKGROUND OF THE INVENTION

1. Technical Field

The invention relates generally to rotary printing machines and in particular offset printing machines of the kind having a plate cylinder and a blanket cylinder driven by a common motor and having means for clamping plates or blankets.

2. Description of the Related Arts

When a blanket or printing plate is clamped or unclamped from a printing press, the printer must operate an "inching" switch repeatedly to move the plate cylinder or blanket cylinder to the necessary or optimum position for the use of a corresponding adjusting tool. Often, the cylinder is inched beyond the required position so that inchings must be repeated but in the opposite direction. This is a laborious, time-consuming and dangerous operation for the printer and adversely affects printing costs.

SUMMARY OF THE INVENTION

With a view to solving this problem, the primary object of the invention is to shorten, simplify and make safer the operations of clamping and unclamping a printing plate or blanket to and from the cylinders of the press.

According to a primary aspect of the invention, therefore, a set-value memory is loaded with at least one cylinder position set value corresponding to the necessary or optimum cylinder position for performing a respective clamping or unclamping operation. A cylinder position sensor senses the actual value of cylinder position. In response to a selectively actuatable triggering unit, a comparator compares the set value stored in the memory to the actual value sensed by the position sensor to generate a corresponding actuating signal for actuating a motor to adjust the cylinder to a predetermined angular position defined by the set value.

When a printer wants to clamp or unclamp a plate or blanket to or from a cylinder, he just actuates the triggering unit. In response, the start or end of the plate or blanket is turned to give the printer the optimum freedom of space for working with a special tool used for the fitting or unfitting operation. In the case of a multicolour press the single triggering unit can control the various cylinders of a printing unit individually. Another possibility is to subdivide the triggering unit into a number of triggering units disposed on each column of a printing unit. In this event the printer has a different triggering button on the triggering unit available for the blanket cylinder and plate cylinder. Possible alternatives to the triggering unit include a light barrier which the printer can interrupt with his elbow in order to bring the cylinder sequentially into the required positions.

Another embodiment uses an ergonomic hand grip enabling the printer to achieve automatic sequential switching by triggering at the required time.

The required positions or set values are preferably grouped according to the overall function or operation to be performed, such as plate clamping, plate unclamping, blanket clamping, and blanket unclamping. Furthermore, the required positions or set values for a particular function are preferably ordered according to the time sequence in which the cylinders are moved to the required positions to perform the respective operation. The particular operations and required positions depend on the type of press, the specific clamping mechanism used and the accessibility of the clamping mechanism.

In general, plate clamping requires at least three positions for performing the following steps:

(1) Moving the plate cylinder to the start of printing, clamping the plate and tightening a quickclamping bar;

(2) Turning the plate cylinder forwards, tightening the plate and placing the plate in a rear clamping bar and tightening the latter until the plate is clamped; and (3) Turning the plate cylinder backwards and retightening the quick-clamp bar screws, with adjustment of the printing plates.

Blanket changing is a rarer occurrence and typically involves the following sequence of steps:

(1) Moving the blanket cylinder so that a duct cover can be removed;

(2) Latching a blanket clamping bar to the print start in the clamps and clamping documents in a paper bar;

(3) Moving the blanket cylinder in the printing direction as far as the end of run and clamping the blanket tightly, engaging an "end of print" blanket clamping bar and tightening the blanket from the end of print direction.

These steps have to be repeated with repeated adjustment to an extent depending upon the printer's skill.

Upon the completion of clamping and adjustment, the printer runs the press and continuous printing occurs for a few minutes. Then the printer shuts off the press and retightens the clamping mechanism in the sequence just mentioned.

By employing the present invention, all of these operations can be called up readily just by pressing buttons or in the case of the light barrier just by the printer using his elbow. The printer can therefore devote his attention to the important aspects of the complicated adjusting operation and is not distracted by the operations automatically performed by the invention.

BRIEF DESCRIPTION OF THE DRAWINGS

Other objects and advantages of the present invention will become apparent upon reading the following detailed description and upon reference to the drawings in which.

While the invention will be described in connection with a preferred embodiment, it will be understood that there is no intention to limit the invention to the construction shown, but the intention is, on the contrary, to cover the various alternatives and equivalent constructions included within the spirit and scope of the appended claims.

DESCRIPTION OF A PREFERRED EMBODIMENT

Figures 1, 2:
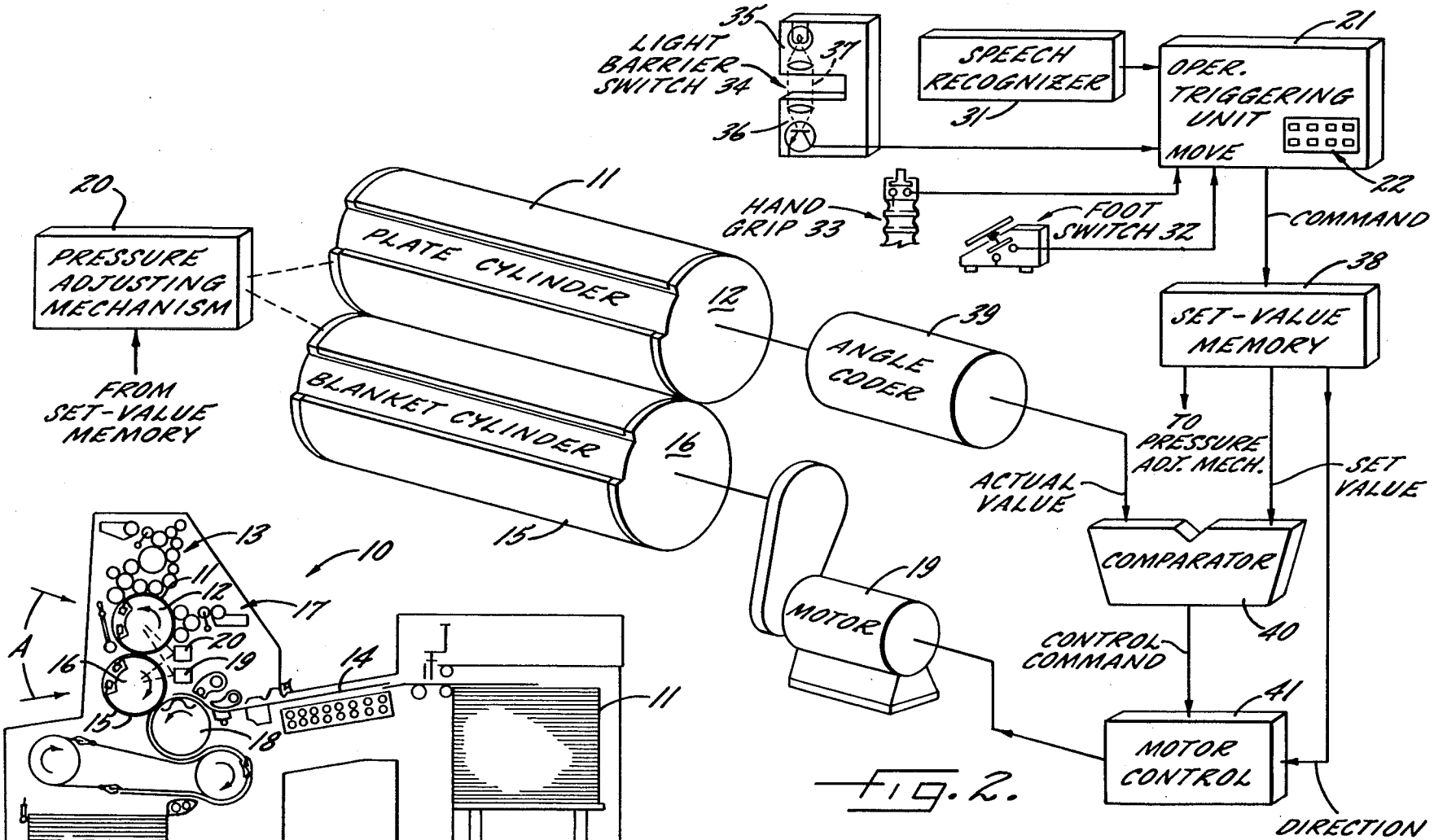
FIG. 1 is a schematic diagram, in side elevation, of a rotary offset printing machine of the kind which incorporates the preferred embodiment of the present invention.
FIG. 2 is a schematic diagram of the preferred embodiment of the invention.

Turning now to FIG. 1, there is shown a rotary offset printing machine generally designated 10 which receives sheets to be printed from a feed table 11 and delivers the printed sheets to a delivery stack 12. In order to define the printed matter, the printing machine 10 includes a printing plate 11 mounted on a plate cylinder 12 and ink is applied to the printing plate via an inking unit generally designated 13. The printing plate, however, does not directly contact the sheets 14 fed through the printing machine; rather, the ink from the printing plate 11 is transferred to a rubber blanket 15 mounted on a blanket cylinder 16. In order to aid the transfer of ink from the printing plate 11 to the rubber blanket 15, the printing plate 11 is dampened by dampening fluid from a damping unit generally designated 17. To produce a print on the fed sheets 14, the fed sheets are conveyed over an impression cylinder 18 which cooperates with the blanket cylinder 16.

In order to change the printing, the printing plate 11 must be replaced with a new printing plate. Also, over a period of time, the rubber blanket 15 must be replaced. Due to the physical construction of the printing machine 10, the insertion and removal of the printing plate 11 or blanket 15 must occur within a restricted area A. Moreover, the insertion or removal of the printing plate or blanket requires the plate cylinder 12 and the blanket cylinder 16 to assume certain required angular positions with respect to the printing machine 10. During printing, the plate cylinder 12 and the blanket cylinder 16 are driven in synchronism by a motor 19, and the plate cylinder 12 and blanket cylinder 16 are selectively engaged by a pressure adjusting mechanism 20. During insertion and removal of the printing plate or blanket, the motor 19 may be used to drive the cylinders 12, 16 to the required positions, or of course a separate motor and clutch arrangement could be used for this purpose. Also, during the insertion or removal of the printing plate or blanket, it may become convenient to selectively actuate the pressure adjusting mechanism 20.

Turning now to FIG. 2, there is shown a preferred embodiment of the invention for automatic plate and blanket cylinder positioning to aid in the insertion and removal of the printing plate 11 and the blanket 15. In order to select various clamping and unclamping operations, a selectively actuable triggering unit 21 receives operator selections, for example from a keyboard and display panel generally designated 22, which is shown in greater detail in FIG. 3. The keyboard, for example, includes a PLATE CLAMP key 23, a PLATE UNCLAMP key 24, a BLANKET CLAMP key 25, a BLANKET UNCLAMP key 26, a MOVE TO NEXT POSITION key 27, a STOP key 28, and digital displays 29 and 30 for indicating a SET VALUE for the cylinder position and the ACTUAL VALUE of the cylinder position, respectively.

The triggering unit 21, however, could receive operator selections from a number of alternative input devices shown in FIG. 2. A speech recognizer 31, for example, could be used to recognize a machine operator speaking the words written on the keys 23–28. The MOVE TO NEXT POSITION operation, however, preferably is actuated by the physical presence of the machine operator since the MOVE TO NEXT POSITION operation commands the plate cylinder 12 and blanket cylinder 16 to move. For safety purposes, this command might not be recognized by the speech recognizer 31. Rather, the MOVE TO NEXT POSITION command could be sensed by a foot switch 32, a hand grip 33, or a light barrier switch 34, all of which require the physical presence of the machine operator in the immediate location of these switches 32–34. The foot switch 32 and hand grip 33 could employ conventional push-button switches. The light barrier switch 34 includes a light source 35, and a light detector 36 such as a phototransistor to sense a beam of light 37 being interrupted by the hand, elbow or arm of the machine operator.

Figure 3:
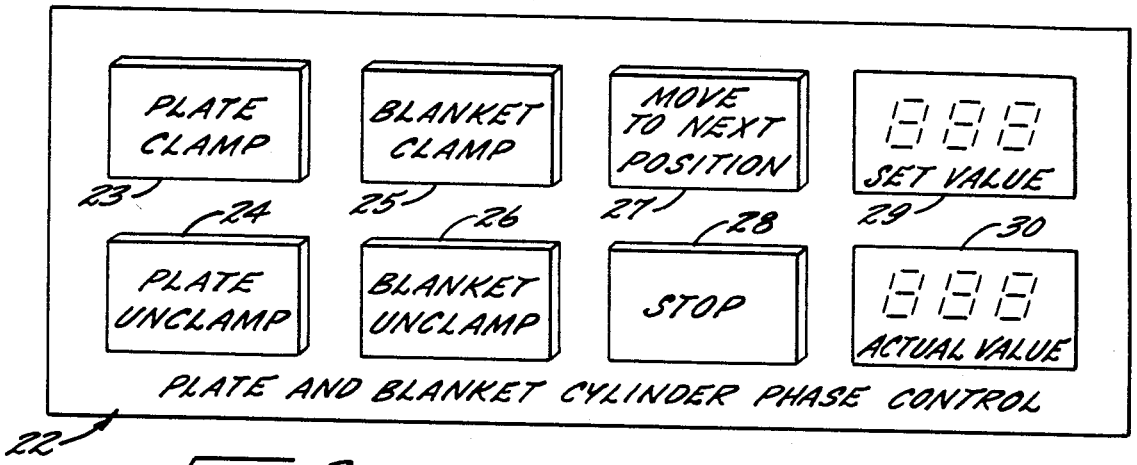
FIG. 3 is a pictorial diagram of a keyboard and display for use in the triggering unit shown in FIG. 2.
Figure 4:
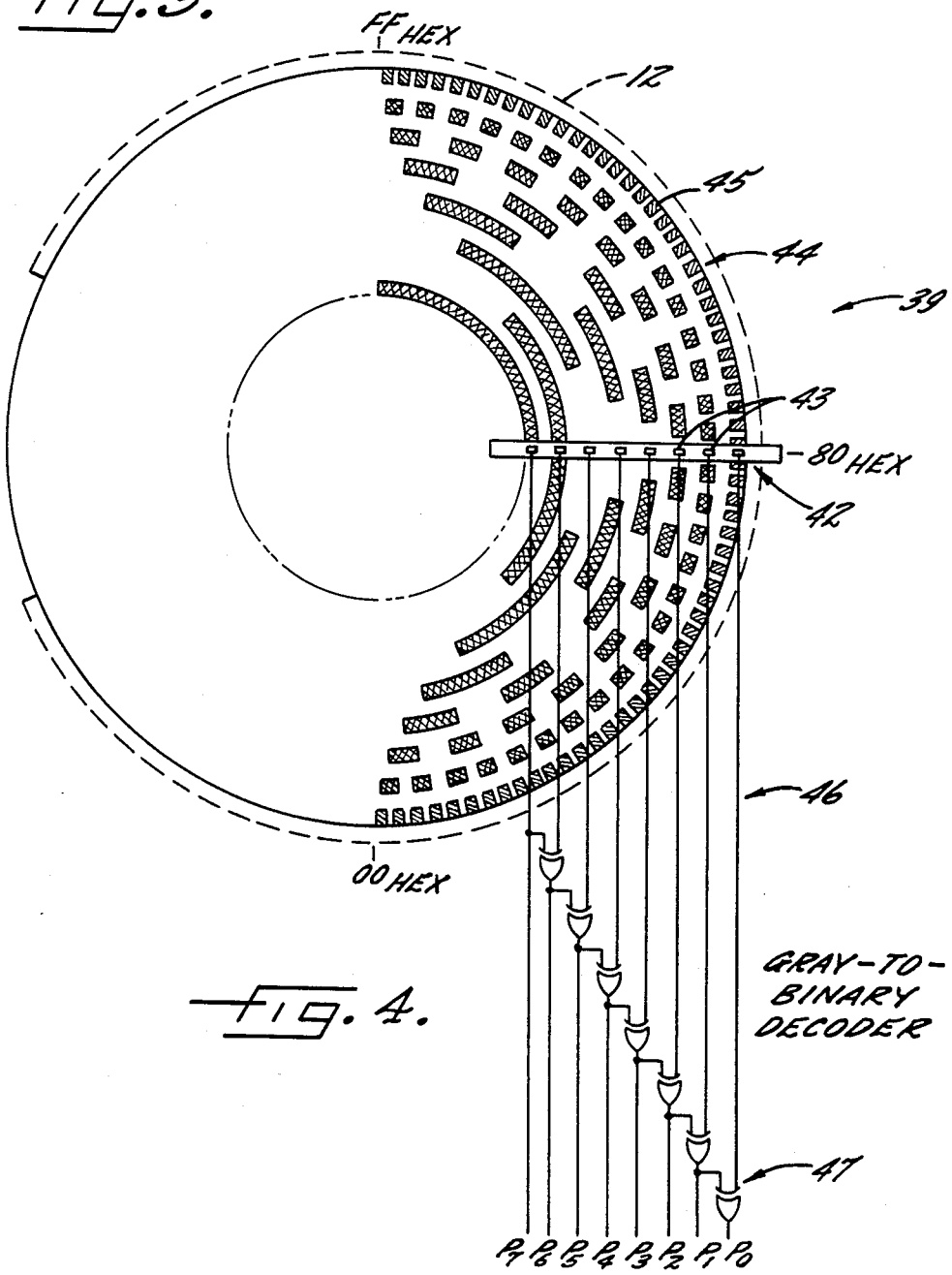
FIG. 4 is a schematic diagram of an angle coder using contactless sensors.

In response to an operator's selection of any of the operations identified in FIG. 3, the triggering unit 21 issues a command to a set-value memory 38 storing respective predetermined angular positions for the plate insertion, plate removal, blanket insertion, and blanket removal adjustments. The set-value memory is addressed by the triggering unit to provide, in sequential order and responsive to the MOVE TO NEXT POSITION operation, respective set values of angular position for the selected plate insertion, plate removal, blanket insertion, and blanket removal adjustments or operations. In order to sense the angular position of the cylinders 12–16 to provide an actual value of angular position, an angle coder 39 is provided such as is shown in FIG. 4 and further described below. In order to actuate the motor 19 so that the cylinders 12, 16 are automatically adjusted to their respective necessary or optimum positions for plate insertion, plate removal, blanket insertion, and blanket removal, a comparator 40 compares the actual value to the set value of cylinder position. In response to actuation of the triggering unit 21, the comparator generates a control command or signal which is passed to the motor control 41 for controlling the motor 19.

During certain moves or steps during the plate insertion, plate removal, blanket insertion, and blanket removal operations, it is desirable to selectively actuate the pressure adjusting mechanism 20 during certain predetermined steps in these operations. Therefore, the set-value memory 38 preferably has stored along with the respective set values a logical flag for indicating whether the pressure adjusting mechanism 20 should be actuated for a given move. Moreover, for certain moves, it is preferable for the cylinders to be rotated in a particular direction. For this purpose, the set-value memory 38 also has stored for the respective set-values, corresponding direction flags which are passed to the motor control 41 for determining the direction in which the motor 19 should run.

Turning now to FIG. 4, there is shown a schematic diagram of a kind of angle coder 39 which is particularly suited for making the present invention. It should be noted that high precision angle coders or rotary position transducers are staple items of commerce. One kind of angle coder, for example, uses an inductive coupling technique and is known as an Inductosyn (Trademark) manufactured and sold by Farrand Controls, 99 Wall Street, Valhalla, N.Y. 10595. For the present invention, however, the angle coder need not resolve the angle of the cylinders to within the full 360° of rotation. Since the cylinders 12, 16 are accessible only over a limited angular range A (FIG. 1) the angle coder need only precisely resolve angles within this limited range A. Therefore, the angle coder 39 shown in FIG. 4 can use an array of contactless proximity sensors generally designated 42 and yet achieve a relatively high angular resolution within the range A even though a small number of contactless sensors 43 are used in the array.

The contactless proximity sensors 43 sense a Gray coded pattern generally designated 44 on a disk or drum rotated in synchronisym with the cylinders, such as the plate cylinder 12 shown in dashed representation. The contactless proximity sensors 43 are, for example, optical or magnetic sensors and the pattern 44 is either comprised of developed patterns in a photographic film or plate, or are magnetized regions on a magnetic disk. A suitable magnetic sensor is a bipolar digital Hall effect sensor part number 617SS4 sold by Micro Switch, A Honeywell Division, 11 West Springs Street, Freeport, Ill. 61032. The pattern 44 is preferably a Gray code to eliminate false responses from the sensor array 42. For the purpose of display, however, a binary or decimal value is preferred. Therefore, the outputs generally designated 46 of the sensor array 42 are passed through a Gray-to-binary decoder generally designated 47 comprising a number of exclusive-OR gates. The output of the Gray-to-binary decoder provides an actual value $P_7$–$P_0$ which, for the case of an array of eight sensors 43, indicates actual values of 00 hexadecimal to FF hexadecimal over an angular range of 180 degrees.

Figure 5:
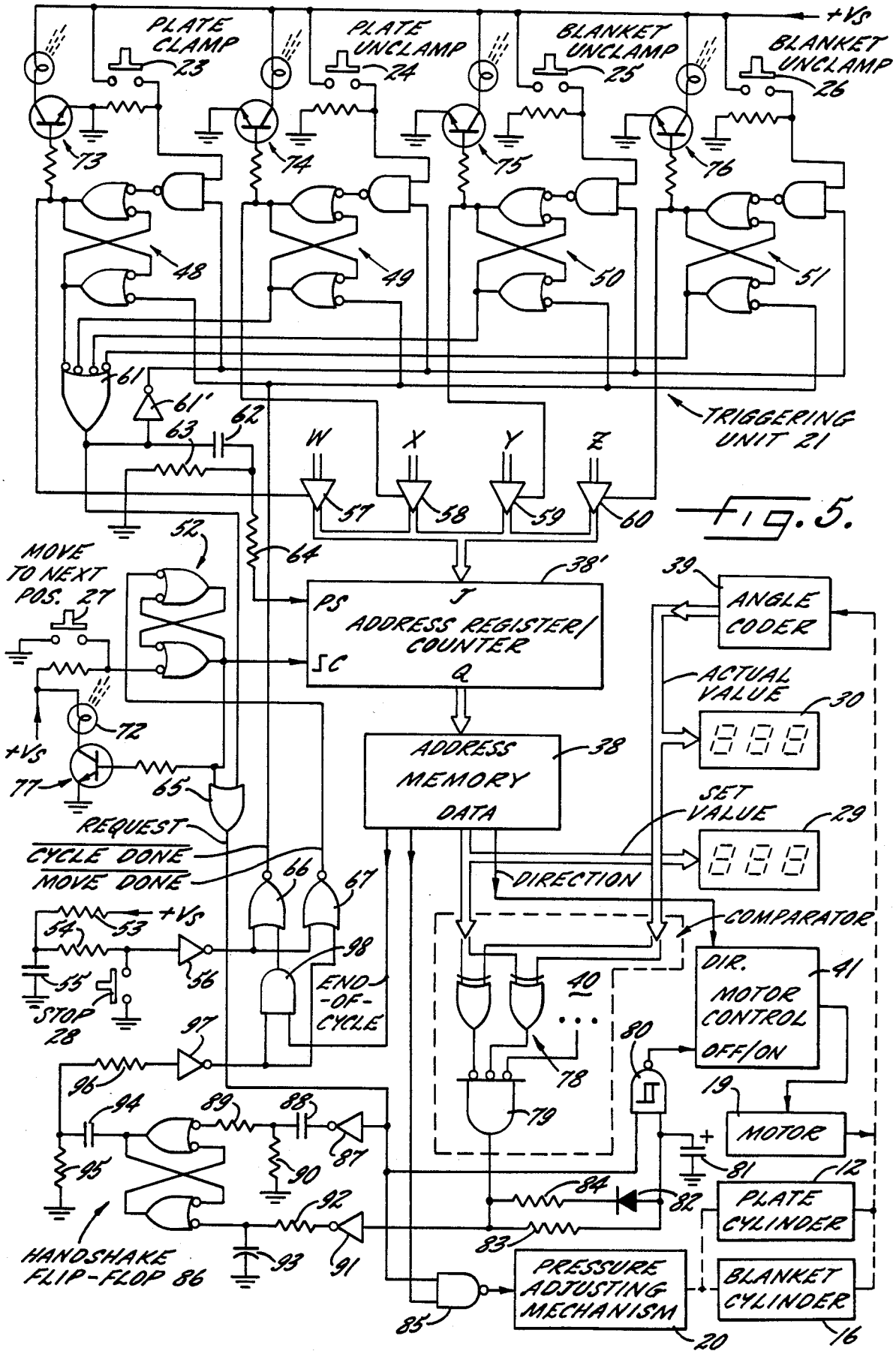
FIG. 5 is an electrical circuit diagram of a hard-wired digital logic circuit for the preferred embodiment of the invention shown in FIG. 2.

Turning now to FIG. 5 there is shown a schematic diagram of a hard-wired logic circuit for use in the embodiment shown in FIG. 2. In addition to the key switches 23–28, the triggering unit 21 includes respective flip-flops 48–51 for registering the actuation of the respective operation key switches 23, 24, 25, 26, and 27. The STOP key switch 28 is used as a reset switch in conjunction with a "power-on" reset circuit including series resistors 53 and 54 working in conjunction with a time delay capacitor 55 and an inverter 56.

In order to address the set-value memory 38 in response to actuation of the triggering unit 21, an associated address register and counter 38' is used to generate an address for the memory. The address register/counter is clocked or incremented by the flip-flop 52 in response to actuation of the MOVE TO NEXT POSITION key switch 27. The other flip-flops 48–51 associated with the operation key-switches 23–26 enable respective tri-state buffers 57, 58, 59 and 60 for strobing a respective starting address W, X, Y, or Z into the jam input J of the address register/counter 38'. A NAND gate 61 in conjunction with a series capacitor 62, and resistors 63 and 64, generates a pre-setting pulse applied to the pre-set input PS of the address register/counter 38' for strobing the address selected by the enabled tristate buffer 57–60 into the address register/counter. The output of the NAND gate 61 is also complemented by an inverter 61' to generate a signal for inhibiting the selection of an operation until the current operation is completed.

The output of the NAND gate 61 is ORed with the output of a flip-flop 52 in an OR gate 65 to generate a request signal for requesting that a move operation be performed. In response to the request signal, a move operation is performed and acknowledged by respective cycle done and move done signals which clear the operation flip-flops 48–51 and 52, respectively. The flip-flops 48–51 and 52 are cleared in response to a reset signal generated by either the power-on condition or actuation of the STOP switch 28 and by two respective NOR gates 66 and 67.

Due to the handshaking between the triggering unit 21 and the other circuits, it is desirable to have the key-switches back-lighted to indicate to the operator that an operation is being performed or that an operation has been completed. For this purpose, the operation key-switches 23–27 are back-lit by respective incandescent lamps driven by respective transistor driver circuits 73–77.

In order to give the operator a visual indication of whether the cylinders 12, 16 are being adjusted to the set-values, displays 29 and 30 indicate the set value and the actual value of the cylinder position. The actual value and set value are also received by the comparator 40 which is comprised of an array of exclusive-OR gates 78 and a NOR gate 79 having a large number of inputs receiving the outputs of the exclusive-OR gates. In order to control the motor 19 in response to the comparison, the request output of the OR gate 65 is combined in a Schmitt trigger NAND gate to generate an off/on signal to the motor control 41. The motor control 41 also receives the direction flag from the data output of the memory 38. The output of the comparator 40, however, is first past through a glitch filter and time delay circuit comprising a time delay capacitor 81, a directional diode 82, and resistors 83 and 84. The time delay is provided so that the pressure-adjusting mechanism 20 is selectively activated by a flag from a data output of the memory 38 before the motor 19 is activated by the motor control 41. The signal for activating the pressure-adjusting mechanism is provided by a NAND gate 85.

In order to clear or acknowledge the request from the OR gate 65 of the triggering unit 21, a handshake flip-flop 86 is provided which is set by the rising edge of the request output of the OR gate 65 and is reset by the comparator 40 indicating that the actual value coincides with the set value. For this purpose, the handshake flip-flop 86 includes a pulse generating circuit comprising an inverter 87 and series capacitor 88, and resistors 89 and 90. The handshake flip-flop 86 also includes a glitch filter including an inverter 91, a series resistor 92, and a shunt capacitor 93. To generate a reset pulse for the set-reset flip-flops 48–52, the handshake flip-flop 86 includes an output pulse forming network comprising a series capacitor 94, resistors 95 and 96, and an inverter 97.

It should be noted that the memory 38 includes a separate set of steps for the plate clamp, plate unclamp, blanket clamp, and blanket unclamp operations, and these series of steps are encoded as data stored at consecutive address locations in the memory 38 starting at the respective addresses W, X, Y, Z. To identify the particular memory location at the end of each set of addresses for the respective operations, and end-of-cycle flag is stored at each respective address location for the operation sequences. The end-of-cycle flag is applied to a NAND gate in conjunction with the output of the inverter 97 to generate the cycle done signal for reseting the operation flip-flops 48–51.

It should be noted that although the circuit in FIG. 5 uses hard-wired logic, the logic could be implemented by software executed by a microcomputer. In such a case, the operation sequences or steps for the respective plate clamp, plate unclamp, blanket clamp, and blanket unclamp operations would be encoded as separate subroutines executed in response to closure of the operation keyswitches 23–26.

In view of the above, a device for adjusting the plate or blanket cylinders in a rotary printing press has been described which automatically moves the cylinders to predetermined positions for clamping or unclamping the plate or blanket. With the aid of this device, the clamping and unclamping of the printing plate or blanket can be easily done relatively quickly and with enhanced safety for the operator.

What is claimed is:

1. A device for a printing machine including a cylinder rotatably driven by a motor, the cylinder having a set of mechanical adjustments capable of being performed by a machine operator only when the cylinder is stationary at certain respective angular positions, said apparatus comprising, in combination, a selectively actuable triggering unit for selecting a mechanical adjustment from said set of mechanical adjustments, a set value memory storing said respective angular positions and being addressed by said triggering unit to provide at least one respective set value of angular position for a selected mechanical adjustment, a cylinder position sensor for sensing the angular position of the cylinder to provide an actual value of angular position, and comparator means for generating a signal to actuate said motor in response to actuation of said triggering unit and in response to a comparison between said set value of angular position provided by said memory and said actual value of angular position provided by said cylinder position sensor, so that said motor adjusts said cylinder to the respective angular position to permit the selected mechanical adjustment to be performed.

2. The device as claimed in claim 1, wherein said set of mechanical adjustments includes a plurality of adjustments, and said triggering unit has a keyboard including keys for operator selection of said plurality of adjustments.

3. The device as claimed in claim 2, wherein said printing machine is an offset machine including a pair of cooperating plate and blanket cylinders, and said keys include keys for a plate clamp adjustment, a plate unclamp adjustment, a blanket clamp adjustment, and a blanket unclamp adjustment.

4. The device as claimed in claim 1, wherein said set of mechanical adjustments includes a plurality of adjustments, and said motor is driven in a forward direction in response to selection of at least one of said adjustments and said motor is driven in a reverse direction in response to selection of at least one other of said adjustments.

5. The device as claimed in claim 1, wherein a plurality of respective set values of angular position are ordered and stored in said memory for at least one multi-position mechanical adjustment, and said triggering unit includes an input means for causing sequential addressing of the next one of said set values for the selected multi-position mechanical adjustment.

6. The device as claimed in claim 5, wherein for some of said set values there are stored in said set value memory respective direction flags, and said motor is driven in a forward or reverse direction in response to said direction flags when the cylinder is driven to angular positions indicated by the corresponding set values.

7. The device as claimed in claim 5, wherein said input means includes a foot switch.

8. The device as claimed in claim 5, wherein said input means includes a light barrier switch.

9. The device as claimed in claim 1, wherein the triggering unit includes a speech input device.

10. The device as claimed in claim 1, wherein the cylinder position sensor is an angle coder which rotates with said cylinder.

11. The device as claimed in claim 1, wherein the cylinder position sensor includes a plurality of contactless proximity switches.

12. The device as claimed in claim 1, wherein said printing machine includes another cylinder, and upon actuation of the triggering unit a pressure-adjusting mechanism for the cylinders is also triggerable before energization of the motor.

13. An automatic cylinder positioning system for aiding in the insertion and removal of a printing plate in a rotary printing machine, the printing plate being inserted and removed from a plate cylinder rotatably driven by a motor, the printing plate being capable of being inserted and removed by a machine operator only when the cylinder is stationary at certain respective angular positions, said system comprising, in combination, a selectively actuable triggering unit for selecting a mechanical adjustment from a predetermined set of mechanical adjustments including plate insertion and plate removal, a set-value memory storing said respective angular positions for the plate insertion and plate removal adjustments, and being addressed by said triggering unit to provide at least one respective set value of angular position for a selected mechanical adjustment, a cylinder position sensor for sensing the angular position of the cylinder to provide an actual value of angular position, and comparator means for generating a signal to actuate said motor in response to actuation of said triggering unit and in response to a comparison between said set value of angular position provided by said memory and said actual value of angular position provided by said cylinder position sensor, so that said motor automatically adjusts said cylinder to the respective angular positions for plate insertion and plate removal.

14. The system as claimed in claim 13, wherein the triggering unit includes a keyboard having keys for selecting plate insertion and plate removal.

15. The system as claimed in claim 13, wherein a plurality of respective set values of angular position are ordered and stored in said memory for each of the plate insertion and plate removal operations, and said triggering unit includes an input means for causing sequential addressing of the next one of said set values for a selected one of the plate insertion and plate removal operations.

16. The device as claimed in claim 15, wherein for some of said set values there are stored in said set value memory respective direction flags, and said motor is driven in a forward or reverse direction in response to said direction flags when the cylinder is driven to angular positions indicated by the corresponding set values.

17. An automatic plate and blanket cylinder positioning system for aiding in the insertion and removal of a printing plate and blanket in a rotary offset printing machine including a plate cylinder and blanket cylinder being rotatably driven by a motor, the printing plate and blanket being capable of being inserted and removed by a machine operator only when the cylinders are stationary at certain respective angular positions, said system comprising, in combination, a selectively actuable triggering unit for selecting a mechanical adjustment from a predetermined set of mechanical adjustments including plate insertion, plate removal, blanket insertion and blanket removal, a set-value memory storing said respective angular positions for the plate insertion, plate removal, blanket insertion, and blanket removal adjustments, and being addressed by said triggering unit to provide at least one respective set value of angular position for a selected mechanical adjustment, a cylinder position sensor for sensing the angular position of the cylinders to provide an actual value of angular position, and comparator means for generating a signal to actuate said motor in response to actuation of said triggering unit and in response to a comparison between said set value of angular position and said actual value of angular position provided by said cylinder position sensor, so that said motor automatically adjusts said cylinders to the respective angular positions for plate insertion, plate removal, blanket insertion and blanket removal.

18. The system as claimed in claim 17, wherein a plurality of respective set values of angular positions are ordered and stored in said memory for each of the plate insertion, plate removal, blanket insertion, and blanket removal operations, and said triggering unit includes an input means for causing sequential addressing of the next one of said set values for a selected one of the plate insertion, plate removal, blanket insertion and blanket removal operations.

19. The device as claimed in claim 18, wherein for some of said set values there are stored in said set value memory respective direction flags, and said motor is driven in a forward or reverse direction in response to said direction flags when the cylinders are driven to angular positions indicated by the corresponding set values.

20. The device as claimed in claim 17, wherein upon actuation of the triggering unit a pressure-adjusting mechanism for the cylinders is also triggerable before energization of the motor.

* * * * *